United States Patent [19]

Fallon

[11] Patent Number: 4,768,652

[45] Date of Patent: Sep. 6, 1988

[54] CASE FOR DISPLAYING AND STORING AN ELECTRIC TOOL, SUCH AS A MINI-DRILL

[75] Inventor: Régis Fallon, Le Perreux sur Marne, France

[73] Assignee: La Francaise Metallurgie, S.A., France

[21] Appl. No.: 48,822

[22] Filed: May 12, 1987

[30] Foreign Application Priority Data

May 13, 1986 [FR] France ..... 86 06857

[51] Int. Cl.[4] ..... B65D 81/36

[52] U.S. Cl. ..... 206/373; 206/379; 312/DIG. 33

[58] Field of Search ..... 206/45, 17, 333, 379, 206/349, 328, 373; 312/DIG. 33; 30/DIG. 1; 15/DIG. 1; 320/2; 310/50

[56] References Cited

U.S. PATENT DOCUMENTS

| | | | |
|---|---|---|---|
| 2,305,021 | 12/1942 | Meier | 206/379 |
| 2,801,330 | 7/1957 | Gay | 362/156 |
| 3,371,975 | 5/1968 | Meltzer | 312/236 |
| 3,497,676 | 2/1970 | Gravatt | 206/333 |
| 3,815,614 | 6/1974 | Waters, Jr. | 206/349 X |
| 3,979,228 | 9/1976 | Marchetti | 206/333 X |
| 4,266,835 | 5/1981 | Schmidt | 312/DIG. 33 |
| 4,303,158 | 12/1981 | Perkins | 312/DIG. 33 |
| 4,334,724 | 6/1982 | Rogers, Sr. | 206/349 X |
| 4,641,076 | 2/1987 | Linden | 320/2 |

FOREIGN PATENT DOCUMENTS

| | | | |
|---|---|---|---|
| 3314251 | 10/1984 | Fed. Rep. of Germany | 320/2 |

OTHER PUBLICATIONS

French Search Report No. FR 86 06 857, FA 378 573, 27 Feb. 1987.

*Primary Examiner*—Jimmy G. Foster
*Attorney, Agent, or Firm*—Marvin Feldman

[57] ABSTRACT

The invention relates to a case for displaying and storing electric tools such as a mini-drill and the case also contains a shelf (38) for displaying and supporting accessories (14) usable with the mini-drill (12), together with a compartment on the back of the case for receiving a source of electric energy such as rechargeable or non-rechargeable batteries suitable for feeding electric power to the mini-drill.

9 Claims, 3 Drawing Sheets

CASE FOR DISPLAYING AND STORING AN ELECTRIC TOOL, SUCH AS A MINI-DRILL

The invention relates to a case for displaying and storing an electric tool such as a mini drill, said case also serving for transporting said tool and for providing it with an independent power supply.

BACKGROUND OF THE INVENTION

Electric tools of this type are now common, for example in model making, decoration, restoration, light engineering, electronics, etc. They are generally packed and displayed in boxes or cases of the tamper-proof type, made of plastic material, and capable of being re-used after they have been opened for storing mini-tools and their accessories (drill bits, grindstones, milling cutters, pliers, wrenches, etc.). These mini-tools are fitted with electric motors which run at low voltage (e.g. 12 to 15 volts), and which are powered via a transformer which is plugged into the mains (e.g. 220 or 110 volts AC).

Such mini-tools must therefore be used under conditions which are much the same as the conditions under which conventional full-size tools are used, that is to say mini-tools still need plugging into the mains and they still require their boxes or cases to be close at hand in order to store and change accessories, and this in spite of the fact that by virtue of their very small size and ease of handling, such mini tools should be capable of being used with fewer constraints than apply to conventional tools.

The aim of the invention is to provide a simple, effective, and cheap solution to these problems by means of a special design of a display and storage case for a mini-tool.

SUMMARY OF THE INVENTION

To this end, the present invention provides a case for displaying and storing an electric tool such as a mini-drill, the case comprising a tool-storing compartment, means for displaying and storing accessories fittable to said tool, e.g. drill bits, grindstones or the like, and a lid for closing said compartment which lid also covers the means for displaying and storing the accessories, said case including the improvement whereby it also constitutes a case for transporting the tool and for providing an independent power supply therefor, such as a compartment in said case suitable for housing for a battery (which may be rechargeable or non-rechargeable) and connected via a connector to tool power supply cord.

It is thus possible with a case in accordance with the invention to use the electric tool even if a main outlet is not available. This makes the tool very convenient to use.

Advantageously, the case includes a clip on one of its vertical faces and suitable for supporting the case.

As a result the case can be attached to a pocket or to the belt of the user.

In a particular embodiment of the invention, the case is generally rectangular in shape and the means for displaying and storing the accessories comprise a transverse shelf having one side which supports a slide constituting a closure member for closing the above-mentioned cover.

The transverse shelf may include holes or notches for receiving the shafts or stems of the accessories, and/or other means for holding said accessories in place.

The above-mentioned cover is advantageously made of transparent material and is pivotally-mounted to the top face of the case so as to close at least a portion of said top face together with a portion of the front face of the case.

The bottom portion of the front face of the case may be closed by another cover pivotally-mounted about the bottom edge of said front face and held in its closure position by the same closure member as holds the cover for closing the top portion of the front face of the case.

The compartment for receiving the independent power supply is advantageously formed on the back of the case and is closed by a cover which is removable or which is hinged.

A compact case is thus obtained which can be used for displaying and packaging the electric tool and its accessories and which can also be used for transporting them and for supplying electric power to the tool.

BRIEF DESCRIPTION OF THE DRAWINGS

An embodiment of the invention is described by way of example with reference to the accompanying drawings, in which.

MORE DETAILED DESCRIPTION

Figure 1:
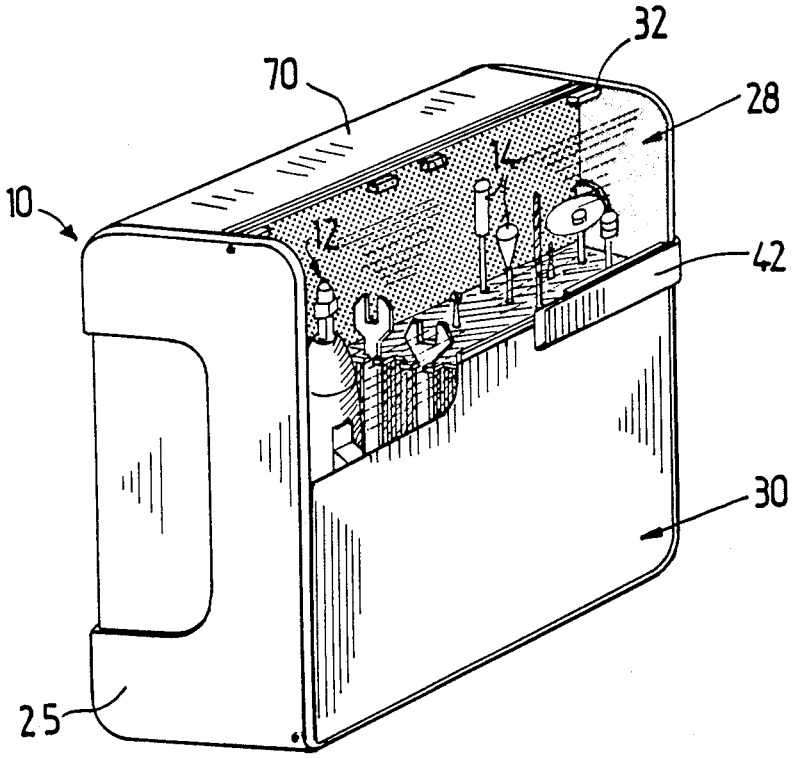
FIG. 1 is a diagrammatic perspective view of a case in accordance with the invention.

The case 10 shown in the accompanying drawings is generally rectangular in shape and is made of rigid plastic material. It is intended to contain an electric mini-drill 12 together with its accessories 14, e.g. drill bits, grindstones, milling cutters, wrenches, etc. The mini-drill 12 has an electric motor suitable for being connected via a power cord 16 to a source of low voltage electrical energy (e.g. 12 volts DC).

The case 10 is divided by an internal partition 18 running parallel to its two largest faces into a front compartment 20 and a back compartment 22. The front compartment 20 is used for displaying and storing the mini-drill 12, its accesssories 14, and its power supply cord 16. This compartment is delimited by the two vertical side walls 24 and 25 and by the horizontal bottom wall 26 of the case 10 and also by a top cover 28 and a bottom cover 30.

The top cover 28 is made of transparent plastic material and comprises two perpendicular faces 29 and 34 which are connected to each other via a rounded portion 31. The top cover 28 is pivotally-mounted about a horizontal axis on the top horizontal edge of the internal partition 18 of the case 10 (or at least in the vicinity of said top horizontal edge) by means of circularly arcuate tabs 32 situated close to the free edge of the face 34 of the cover. This allows the cover to be opened through 135° and facilitates grasping the accessories 14. Thus, and as can be seen in FIG. 1, the top cover 28 serves to close the front half of the top face of the case 10 and the top half of its front face.

The bottom cover 30 is pivotally-mounted about a horizontal axis at the bottom of the front face of the case 10 by means of small cylindrical rods received in bearings 36 formed in the bottom horizontal edge of the cover 30.

In the closed position, the top and bottom covers 28 and 30 come substantially into contact level with a horizontal transverse shelf 38 constituting the support for the accessories 14 and projecting from the internal vertical partition 18 and the side wall 24 of the case 10. Along its front horizontal edge, this shelf 38 has a T-shaped rim 40 with vertical flanges serving to guide and retain a slide 42 which constitutes a closure member for the top and bottom covers 28 and 30.

To this end, the free transverse edge of the bottom cover 30 has a cutout 44 running parallel to the axis of rotation of said cover and running from one of its side edges 46 over a length which is slightly shorter than the length of the slide 42 up to a projecting tab 48 which extends the bottom cover 30 and which includes a chamfered edge 50 where it joins the cutout 44 in order to co-operate with a sloping end face 52 of the slide 42.

Similarly, the free transverse edge of the top cover 28 includes a similar cutout 54 running parallel to the axis of rotation of the top cover and extending over a greater length than the cutout 44 and connected by a chamfered edge 56 to a tab 58. When both covers 28 and 30 are closed, their horizontal cutouts 44 and 54 are located on either side of the slide 42 and the sloping end 52 of the slide can run over the chamfered edges 50 and 56 of the covers in order to hold them in the closed position. The edges of the tabs 48 and 58 on the covers press against one another substantially in the middle of the rim 40 of the transverse shelf 38 as shown in FIG. 1.

By virtue of this configuration, and in particular by virtue of the different lengths of the cutouts 44 and 54, the slide 42 has three functionally distinct positions:

a fully-closed position in which sloping end 52 of the slide 42 is engaged over the chamfered edges 50 and 56 in order to retain both covers in the closure postion (this is the left-most position of the slide 42 as shown in FIG. 1);

an intermediate position allowing the top cover 28 to be opened, in which position the slide 42 has been moved a short distance to the right to enable its sloping end 52 to release the tab 58 on the top cover while still retaining the chamfered edge 50 of the tab 48 on the bottom cover; and a fully-open position allowing the bottom cover 30 to be opened as well, in which position the slide 42 is moved further to the right from the intermediate position, thereby releasing the tab 48. In this position both tabs 48 and 58 are released and both covers 28 and 30 may be opened.

The slide 42 has an inside projection for indexed latching in hollows provided in the vertical flanges of the rim 40 in each of three above-described positions. This also prevents the slide 40 from being withdrawn by accident from the rim 40.

Figure 2:
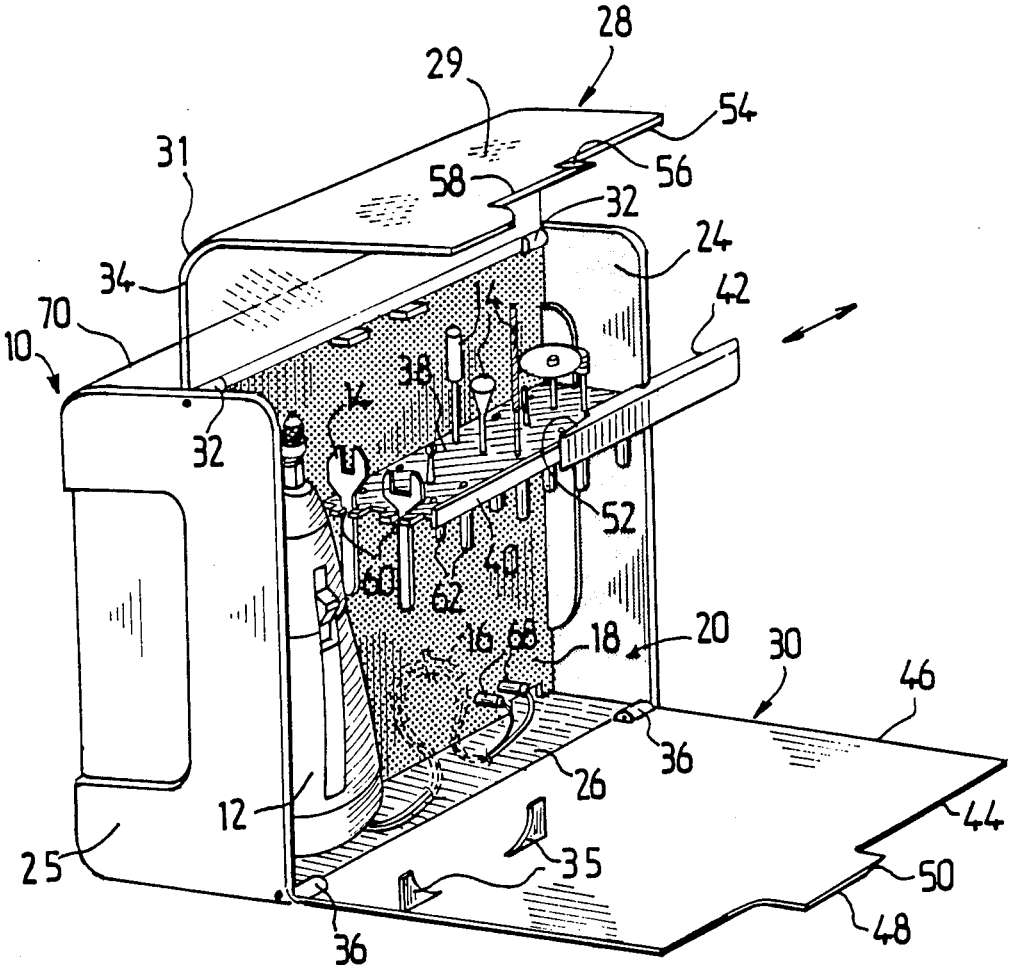
FIG. 2 shows the case in the open position.
Figure 3:
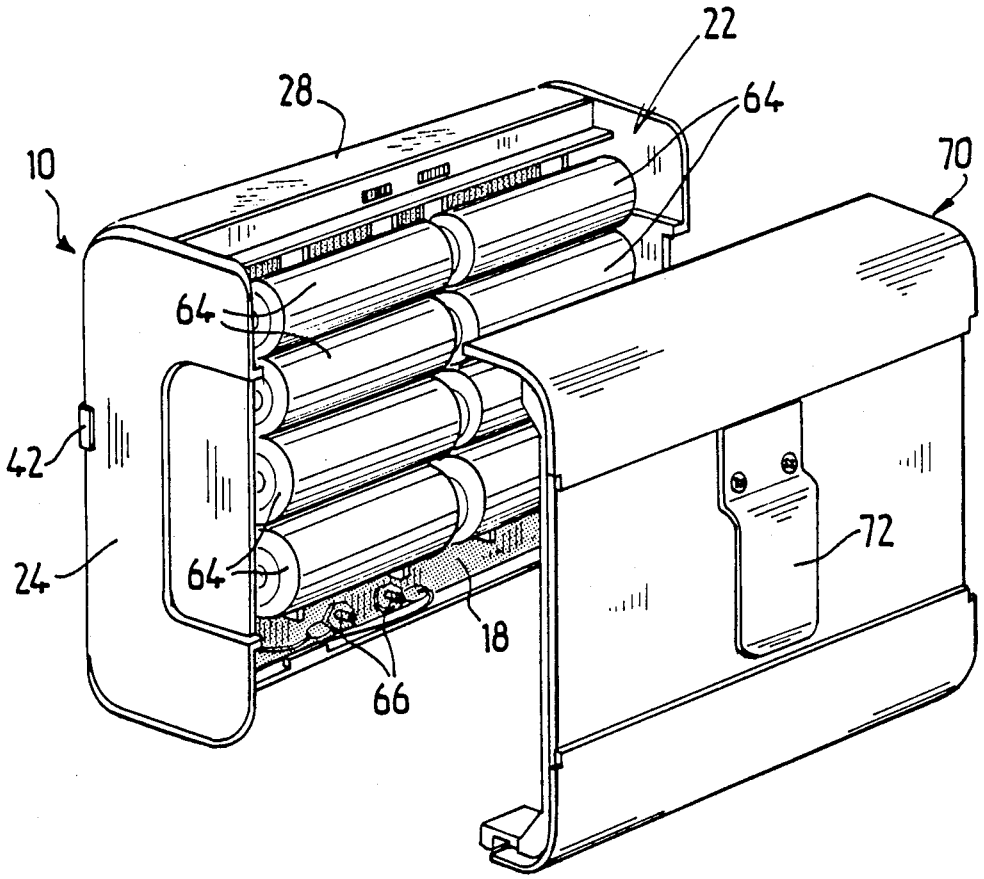
FIG. 3 is a diagrammatic exploded perspective view of the back of a case in accordance with the invention.

The shelf 38 ends at a distance from the side wall 25 on the case 10 and delimits in conjunction with said wall 25 a space for receiving the mini-drill 12 in a vertical position. Such storage is facilitated by horizontal and substantially semicircular cradles which are integrally molded to project inwardly from the inside partition 18 and from the inside face of the bottom cover 30, as shown at 35 in FIG. 2, thereby holding the mini-drill 12 in place.

The horizontal shelf 38 includes various means for supporting accessories 14, for example in the form of openings or notches 60 formed in its free edge perpendicular to the large faces of the case in order to receive the handles of wrenches, and vertical ducts suitable for receiving the stems or shafts of drill bits, grindstones, and milling cutters suitable for mounting on the mini-drill 12. Said vertical ducts are formed by cylindrical tubes 62 integrally molded with the bottom face of the shelf 38, opening out at their top ends in the top face of the shelf, and closed at their bottom ends.

The back compartment 22 of the case 10 includes conventional means for receiving a plurality of electric cells 64, e.g. conventional 1.5 volt cylindrical cells, which cells are connected in series inside the compartment 12 in order to deliver 12 volts DC. The terminals of this battery of cells are connected by conductors to two sockets 66 which pass through the intermediate partition 18 of the case 10 and which open out into the front compartment 20 in order to receive connection plugs 68 mounted on the ends of two electric wires in the power cord 16 for the mini-drill 12. This cord should be of adequate length to facilitate use of the mini-drill 12 and sufficient space is provided for storing it underneath the transverse shelf 38.

The back compartment 22 of the case 10 is closed by a removable cover 70 of the snap-fastening type, and the outside surface of the cutter has a retaining clip 72 suitable for hooking the case 10 in a pocket or to the belt of a user.

The case 10 is used not only for displaying and packaging the mini-drill 12 together with its accessories 14 for sales purposes, but also during subsequent use and for storage in between occasions on which they are used.

In the position shown in FIG. 1, the slide 42 holds both covers 28 and 30 in the closed position. When the slide is moved outwardly along the rim 40 of the transverse shelf 38, it initially releases the top cover 28 for pivoting purposes and then in its outermost position it releases both covers for pivoting purposes.

The source of electric power in the case may alternatively be constituted by rechargeable batteries that can be connected to a charger, itself connected to mains when the mini-drill is not in use. The outside dimensions of the case may be about 112 mm×65 mm×130 mm.

I claim:

1. A case for displaying and storing an electric tool such as a mini-drill, the case comprising a tool-storing compartment, means for displaying and storing accessories fittable to said tool, and a cover for closing said compartment, said cover also covering the means for displaying and storing the accessories, said case including the improvement comprising a case for transporting the fool and for providing an independent power supply for the tool, and includes a compartment suitable for housing said power supply, said power supply being connected to a supply cord connector for the tool, wherein the case is substantially rectangular in shape and wherein said means for displaying and storing the accessories comprises a transverse shelf having one side which supports a slide constituting a closure member for the cover.

2. A case according to claim 1, wherein the cover is made of transparent material and is pivotally-mounted to the top face of the case in order to close at least a portion of said top face and at least a portion of the front face of the case.

3. A case according to claim 2, wherein the bottom portion of its front face is closed by another cover which is pivotally-mounted about the bottom edge of said front face and which is held in its closed position by the said slide.

4. A case according to claim 3, wherein the inside face of said other cover includes means for holding the electric tool in its compartment.

5. A case according to claim 1, wherein the compartment for receiving the source of electric energy is formed on the back of the case and is closed by a cover.

6. A case according to claim 1, including a clip on one of its vertical faces from which the case may be suspended.

7. A case according to claim 1, wherein said shelf is connected to one of the side walls of the case and ends at a distance from the opposite side wall, thereby delimiting in conjunction with said opposite side wall a free space suitable for receiving and storing the tool.

8. A case according to claim 7, wherein the transverse shelf comprises means such as openings and cylindrical passages in which the stems or shafts of the accessories are received.

9. A case according to claim 1, wherein the case is made of rigid plastic material.

* * * * *